US009755337B2

(12) United States Patent
Brzezinski et al.

(10) Patent No.: US 9,755,337 B2
(45) Date of Patent: Sep. 5, 2017

(54) WATERPROOF BOARD-TO-BOARD CONNECTORS

(71) Applicant: APPLE INC., Cupertino, CA (US)

(72) Inventors: Makiko K. Brzezinski, Santa Clara, CA (US); Tyler S. Bushnell, Mountain View, CA (US); David I. Nazzaro, Saratoga, CA (US)

(73) Assignee: APPLE INC., Cupertino, CA (US)

( * ) Notice: Subject to any disclaimer, the term of this patent is extended or adjusted under 35 U.S.C. 154(b) by 33 days.

(21) Appl. No.: 14/843,905

(22) Filed: Sep. 2, 2015

(65) Prior Publication Data

US 2016/0190719 A1 Jun. 30, 2016

Related U.S. Application Data

(60) Provisional application No. 62/044,917, filed on Sep. 2, 2014.

(51) Int. Cl.

| | |
|---|---|
| ***H01R 12/00*** | (2006.01) |
| ***H01R 12/71*** | (2011.01) |
| ***H01R 12/73*** | (2011.01) |
| ***H01R 43/00*** | (2006.01) |
| *H01R 43/20* | (2006.01) |
| *H01R 13/52* | (2006.01) |

(52) U.S. Cl.

CPC ..... *H01R 12/716* (2013.01); *H01R 12/73* (2013.01); *H01R 13/5219* (2013.01); *H01R 43/005* (2013.01); *H01R 13/5216* (2013.01); *H01R 43/205* (2013.01)

(58) Field of Classification Search

CPC ..... H01R 12/716; H01R 43/205; H01R 13/52

USPC ..... 439/74

See application file for complete search history.

(56) References Cited

U.S. PATENT DOCUMENTS

| | | | |
|---|---|---|---|
| 3,662,321 | A | 5/1972 | Bury |
| 3,721,940 | A | 3/1973 | Michel et al. |
| 3,796,986 | A | 3/1974 | Tamburro |
| 4,012,093 | A | 3/1977 | Crane |
| 4,057,311 | A | 11/1977 | Evans |
| 4,416,496 | A | 11/1983 | Brefka |
| 4,538,865 | A | 9/1985 | Wakabayashi et al. |
| 4,587,377 | A | 5/1986 | Rodseth |

(Continued)

OTHER PUBLICATIONS

Non-Final Office Action dated Apr. 6, 2015 for U.S. Appl. No. 14/177,023, 9 pages.

(Continued)

*Primary Examiner* — Abdullah Riyami
*Assistant Examiner* — Nader Alhawamdeh
(74) *Attorney, Agent, or Firm* — David K. Cole; Joseph F. Guihan

(57) ABSTRACT

Board-to-board connectors that may provide durable and reliable connections, may save board space, and may be easy to manufacture. One example may provide board-to-board connectors that provide durable connections by providing a seal between board-to-board plugs and receptacles. The seal may be an O-ring, gasket, or other seal. The seal may protect contacts on the board-to-board connectors from exposure to fluids, such as water or other corrosive fluids. This seal may provide a level of redundancy with one or more seals protecting a device from external fluids, such as a seal at or in the device enclosure.

18 Claims, 19 Drawing Sheets

(56) References Cited

U.S. PATENT DOCUMENTS

| | | | | |
|---|---|---|---|---|
| 4,636,018 | A | 1/1987 | Stillie | |
| 4,647,125 | A | 3/1987 | Landi et al. | |
| 4,693,529 | A | 9/1987 | Stillie | |
| 4,695,258 | A | 9/1987 | Hanson et al. | |
| 4,723,196 | A * | 2/1988 | Hofmeister | H01R 12/7082 174/541 |
| 4,913,656 | A | 4/1990 | Gordon et al. | |
| 4,929,185 | A | 5/1990 | Wong et al. | |
| 4,948,374 | A | 8/1990 | Carter | |
| 4,950,175 | A * | 8/1990 | Plyler | H01R 13/5221 439/274 |
| 4,998,887 | A | 3/1991 | Kaufman et al. | |
| 5,051,366 | A | 9/1991 | Anderson et al. | |
| 5,152,694 | A | 10/1992 | Bargain | |
| 5,160,269 | A | 11/1992 | Fox, Jr. et al. | |
| 5,219,293 | A | 6/1993 | Imamura | |
| 5,221,209 | A | 6/1993 | D'Amico | |
| 5,252,079 | A | 10/1993 | Grabbe | |
| 5,259,781 | A | 11/1993 | Baumberger et al. | |
| 5,295,838 | A | 3/1994 | Walen et al. | |
| 5,384,433 | A | 1/1995 | Osann, Jr. et al. | |
| 5,525,064 | A | 6/1996 | Mowry | |
| 5,575,686 | A | 11/1996 | Noschese | |
| 5,609,491 | A * | 3/1997 | Cooper | H01R 12/57 439/494 |
| 5,685,073 | A | 11/1997 | Estes et al. | |
| 5,700,151 | A * | 12/1997 | Korsunsky | H01R 4/028 439/74 |
| 5,730,619 | A | 3/1998 | Hamlin | |
| 5,871,362 | A | 2/1999 | Campbell et al. | |
| 6,017,244 | A | 1/2000 | Daane | |
| 6,039,581 | A | 3/2000 | DiMarco | |
| 6,077,090 | A | 6/2000 | Campbell et al. | |
| 6,257,918 | B1 | 7/2001 | Yamamoto | |
| 6,309,223 | B1 | 10/2001 | Wolfe | |
| 6,368,117 | B1 | 4/2002 | Taylor | |
| 6,409,526 | B1 | 6/2002 | Malone et al. | |
| 6,425,768 | B1 | 7/2002 | Taylor | |
| 6,431,879 | B2 | 8/2002 | Brekosky et al. | |
| 6,520,789 | B2 | 2/2003 | Daugherty, Jr. et al. | |
| 6,579,104 | B1 | 6/2003 | Bishop et al. | |
| 6,614,659 | B2 | 9/2003 | Feigenbaum et al. | |
| 6,634,890 | B2 | 10/2003 | Peterson et al. | |
| 6,822,466 | B1 | 11/2004 | Holcombe et al. | |
| 6,843,629 | B2 | 1/2005 | Farral et al. | |
| 6,863,543 | B2 | 3/2005 | Lang et al. | |
| 6,869,291 | B2 | 3/2005 | Norland et al. | |
| 6,926,537 | B1 | 8/2005 | Auchincloss et al. | |
| 7,046,020 | B2 | 5/2006 | LaMeres et al. | |
| 7,101,196 | B1 * | 9/2006 | McClelland | H01R 12/716 439/521 |
| 7,223,106 | B2 * | 5/2007 | Nakajima | H01R 12/716 411/178 |
| 7,323,892 | B1 | 1/2008 | LaMeres et al. | |
| 7,347,719 | B2 | 3/2008 | Geibel et al. | |
| 7,407,408 | B1 | 8/2008 | Taylor | |
| 7,438,582 | B2 | 10/2008 | Taylor | |
| 7,465,195 | B1 | 12/2008 | Kerrigan et al. | |
| 7,740,489 | B2 | 6/2010 | Trout et al. | |
| 8,251,712 | B2 | 8/2012 | Cheng | |
| 8,758,067 | B2 | 6/2014 | Rathburn | |
| 9,209,540 | B2 * | 12/2015 | Raff | H01R 12/716 |
| 2002/0142629 | A1 * | 10/2002 | Zaderej | H01R 13/24 439/74 |
| 2003/0113183 | A1 | 6/2003 | McAfee | |
| 2004/0258500 | A1 | 12/2004 | Ireland | |
| 2006/0216960 | A1 | 9/2006 | Chang | |
| 2006/0264096 | A1 | 11/2006 | Johnson | |
| 2010/0093193 | A1 | 4/2010 | Trout et al. | |
| 2014/0113475 | A1 | 4/2014 | Malek et al. | |
| 2014/0120788 | A1 | 5/2014 | Kodaira et al. | |
| 2014/0148021 | A1 * | 5/2014 | Hsu | H01R 12/79 439/67 |
| 2014/0302692 | A1 | 10/2014 | Raff et al. | |
| 2015/0222044 | A1 * | 8/2015 | Arai | H01R 13/5219 439/271 |
| 2016/0190719 | A1 * | 6/2016 | Brzezinski | H01R 12/73 439/74 |

OTHER PUBLICATIONS

Notice of Allowance dated Jul. 21, 2015 for U.S. Appl. No. 14/177,023, 10 pages.

* cited by examiner

WATERPROOF BOARD-TO-BOARD CONNECTORS

CROSS-REFERENCES TO RELATED APPLICATIONS

This application claims the benefit of U.S. provisional application No. 62/044,917, filed on Sep. 2, 2014, which is incorporated by reference.

BACKGROUND

The number of types of electronic devices that are commercially available has increased tremendously the past few years and the rate of introduction of new devices shows no signs of abating. Devices, such as tablet, laptop, netbook, desktop, and all-in-one computers, cell, smart, and media phones, storage devices, portable media players, navigation systems, monitors, and others, have become ubiquitous.

The functionality of these devices has likewise greatly increased. This in turn has led to increased complexity inside of these electronic devices. For example, several boards, such as flexible circuit boards, printed circuit boards, and others, are often included in a single device. These boards may be connected together using board-to-board connectors.

These board-to-board connectors should typically be durable and reliable. That is, they should be durable to help ensure that the device has a long operational life. They should also form a reliable connection, otherwise disconnections between circuits and components on different boards could occur leading to a loss of functionality or failure of the device. With a reliable connection, if the device is dropped or otherwise jarred, a disconnection may be avoided.

Often these connectors may be large. This, in turn, may consume board area and space inside an electronic device. This may result in either the device having less functionality, a larger size, or a combination of the two. Smaller connectors may save space, allowing more functionality in a device, they may allow a device to be smaller, or a combination of each.

Further board-to-board connectors may also be somewhat complicated to manufacture. This may lead to increased device costs. Connectors that may be easier to manufacture may provide reduce costs. This manufacturability may be enhanced by being able to reconnect the board-to-board connectors more one or more times.

Thus, what is needed are board-to-board connectors that may provide durable and reliable connections. These board-to-board connectors may save board space and may be easy to manufacture.

SUMMARY

Accordingly, embodiments of the present invention may provide board-to-board connectors that may provide durable and reliable connections. These board-to-board connectors may save board space and may be easy to manufacture. An illustrative embodiment of the present invention may provide board-to-board connectors that provide durable connections by providing a seal between board-to-board inserts and receptacles. The seal may be an O-ring, gasket, or other seal. The seal may protect contacts on the board-to-board connectors from exposure to fluids, such as water or other corrosive fluids. This seal may provide a level of redundancy with one or more seals protecting a device from external fluids. If the device is exposed to a corrosive fluid, the external seals may provide a first line of protection. Fluid that may pass the external seal may be blocked by the seal on a board-to-board connector, thereby protecting board-to-board connector contacts and other structures. This may allow an electronic device to maintain functionality even when fluids may enter the device through a seal at or in a device enclosure. This may help protect a device's functionality and help to provide the device with a long life.

Another illustrative embodiment of the present invention may provide a board-to-board connector that provides a reliable connection by providing a seal between board-to-board inserts and receptacles. Again, the seal may be an O-ring, gasket, or other seal. The seal may help keep a board-to-board insert seated in a board-to-board receptacle. This seal may help to keep the insert in place when the device housing the board-to-board connector is subject to shock or other possibly damaging event.

Another illustrative embodiment of the present invention may provide board-to-board connectors that have a small size by utilizing a seal that consumes a small volume. As before, the seal may be an O-ring, gasket, or other seal. The seal may be positioned such that a height of a board-to-board connector is not increased by its inclusion. In other embodiments of the present invention, the seal may be positioned such that a width of a board-to-board connector is not increased by its inclusion.

Another illustrative embodiment of the present invention may provide board-to-board connectors that are readily manufactured. In one embodiment of the present invention, manufacturability may be improved by utilizing a seal that is readily manufactured, such as an O-ring, gasket, or other seal. The O-ring, gasket, or other seal may be placed or seated in a notch in a board-to-board connector insert, receptacle, or both. This increased in manufacturability may extend to the assembly process of the device as well. For example, embodiments of the present invention may provide waterproof or water resistant board-to-board connectors that may be connected and disconnected without losing the waterproofing or resistance. This is particularly important where devices may need to be reworked during assembly such that the board-to-board connectors are connected and disconnected one or more times.

Various embodiments of the present invention may utilize various types of seals. Again, these seals may be O-rings, gaskets, or other types of seals. The seals may be O-rings having at least a roughly circular cross section. Other types of O-rings, such as multi-lobed O-rings may be used. Embodiments may also employ a seal formed of glue, double-sided tape, or other adhesive or adhesive layer, such as a pressure-sensitive adhesive, or other elastomer or other material. The seal may be formed as part of either or both the board-to-board connector receptacle or insert. For example, either the connector receptacle or insert may be formed using a two-shot process where the first shot uses a relativity rigid plastic or other material for a frame and a second shot uses a relatively softer, flexible plastic, elastomer, or other material. In other embodiments of the present invention, a layer may be placed between a connector receptacle and insert before insertion. During insertion, contacts in either the receptacle or insert may pierce the layer to form electrical connections with corresponding contacts in either the insert or receptacle. The layer may be removable to allow for rework or reinsertion of the insert into the receptacle. The layer may be formed of silicone or other material. The O-rings, gaskets, or other types of seals may be lubricated with grease, oil, or other substance to facilitate insertion and extraction of a board-to-board insert into and out of a board-to-board receptacle.

In various embodiments of the present invention, a board-to-board connector insert may include a notch. An O-ring or other seal may be placed or seated in the notch. The notch may be along an outside edge of a connector insert housing. In other embodiments of the present invention, the notch may be along a surface of the connector insert housing that is parallel to a board supporting the insert. In other embodiments of the present invention, the notch may be located along an inside edge of a housing for a board-to-board connector receptacle. In still other embodiments of the present invention, the notch may be along a surface of the connector receptacle housing that is parallel to a board supporting the insert. O-rings, gaskets, or other seals may be located in these notches.

When the insert is inserted into the corresponding receptacle, the O-ring may be in contact with a face of a housing for the receptacle (or insert.) This face may be flat or it may be undercut. The undercut may be used to increase an insertion force that is needed to insert a board-to-board connector insert into a board-to-board connector receptacle and an extraction force that is necessary to extract a board-to-board connector insert from a board-to-board connector receptacle. For example, where a connector and a seal is made using a two-shot process, an extraction force may be tuned by adjusting the durometrics or hardness of the material used to form the seal, the size of the seal, and the depth of the undercut. By tuning the extraction force, the reliability of the connection may be increased and the ability to rework or remake the connection may be preserved. These insertion and extraction forces may replace or supplement insertions and extraction forces that may be provided by clips and notches on either or both a board-to-board connector insert and connector receptacle.

Another illustrative embodiment of the present invention may provide a board-to-board connector system. This system may include a plug and a receptacle. A silicone ring or gasket may form a seal between a shell of the receptacle and a shell of the plug. This seal may prevent the ingress of moisture into the board-to-board connector system. The receptacle may include a housing in a shell. The housing may include a number of slots for contacts. The housing may further include an opening to accept a raised portion on the plug. The plug may include a housing. The plug housing may include a raised portion to mate with an opening in the receptacle housing. Plug contacts may be exposed along the top and sides of the raised portion. Plug contacts may terminate in surface mount portions. A silicone ring or gasket may be formed along an inside portion of the plug shell. When the plug is mated with the receptacle, the raised portion of the plug may be inserted into the opening of the receptacle. The receptacle housing and shell of the receptacle may fit in the recess formed by the shell and silicone ring or gasket of the plug.

Various embodiments of the present invention may utilize various additional techniques for waterproofing or increasing water resistance. For example, a board-to-board connector receptacle or insert may be mounted to a board. The attachment to a board may be potted or sealed using a potting material such as epoxy or other adhesive, a liquid plastic, or other potting material. Alternately, an entire board may be potted or sealed. In these embodiments the board-to-board connector may not be potted in order to allow the board-to-board connector to be reworked or reconnected. This waterproofing, or increase in water resistance may work in conjunction with a seal between the board-to-board insert and receptacle and any seals in a housing of the electronic device to help waterproof or increase the water resistance of the overall device. The boards themselves may be protected with a conformal coating or other protective layer to further improve the waterproofing or water resistance of the device.

Accordingly, when a device is exposed to a fluid, one or more seals at or in a housing or enclosure may protect internal circuits and components. If water or other fluid does get inside the device, components and circuits on a board may be protected by the conformal or other coating, the potting between the board and board-to-board connector, and the seal between the board-to-board receptacle and insert. In still other embodiments of the present invention, a device may be designed to allow fluid ingress. In this case, these board-to-board connectors may protect contacts and other structures from damage due to exposure from these fluids.

Another illustrative embodiment of provides a board-to-board connector for connecting traces on a first board to traces on a second board. One embodiment may provide an electronic device comprising a first board comprising a first plurality of traces. A board-to-board receptacle may be attached to the first board. The board-to-board receptacle may include a first plurality of contacts electrically connected to the first plurality of traces. A board-to-board insert may be inserted in the board-to-board receptacle. The board-to-board insert may include a second plurality of contacts electrically connected to the first plurality of contacts. A seal may be located between the board-to-board receptacle and board-to-board insert. A second board may be attached to the board-to-board insert. The second board may include a second plurality of traces electrically connected to the second plurality of contacts.

The board-to-board connector receptacles and inserts employed by embodiments of the present invention may be connected to various types of boards. For example, they may be connected to flexible circuit boards, printed circuit boards, or other appropriate substrates. These boards may include various layers having traces or planes on them, where the various traces and planes are connected using vias between layers. A flexible or printed circuit board may be formed as part of a larger flexible or printed circuit board that may form a logic or motherboard in an electronic device. In other embodiments of the present invention, these boards may be formed of conductive or metallic traces and planes in or on a nonconductive body. The nonconductive body may be formed of plastic or other materials.

In various embodiments of the present invention, the components of the board-to-board connectors may be formed in various ways of various materials. For example, contacts and other conductive portions of board-to-board connectors may be formed by stamping, metal-injection molding, machining, micro-machining, 3-D printing, or other manufacturing process. The conductive portions may be formed of stainless steel, steel, copper, copper titanium, phosphor bronze, or other material or combination of materials. They may be plated or coated with nickel, gold, or other material. The nonconductive portions, such as the receptacle and insert housings, O-rings, gaskets, and other portions, may be formed using injection or other molding, 3-D printing, machining, or other manufacturing process. The nonconductive portions may be formed of silicon or silicone, rubber, hard rubber, plastic, nylon, elastomers, liquid-crystal polymers (LCPs), ceramics, or other nonconductive material or combination of materials.

Embodiments of the present invention may provide connector receptacles that may be located in, and may connect to, various types of devices, such as portable computing devices, tablet computers, desktop computers, laptops, all-in-one computers, wearable computing devices, cell phones, smart phones, media phones, storage devices, portable media players, navigation systems, monitors, power supplies, adapters, remote control devices, chargers, and other devices. These connector receptacles may provide pathways for signals that are compliant with various standards such as Universal Serial Bus (USB), High-Definition Multimedia Interface® (HDMI), Digital Visual Interface (DVI), Ethernet, DisplayPort, Thunderbolt™, Lightning™, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. In various embodiments of the present invention, these interconnect paths provided by these connector receptacles may be used to convey power, ground, signals, test points, and other voltage, current, data, or other information.

Various embodiments of the present invention may incorporate one or more of these and the other features described herein. A better understanding of the nature and advantages of the present invention may be gained by reference to the following detailed description and the accompanying drawings.

DESCRIPTION OF EXEMPLARY EMBODIMENTS

Figure 1:
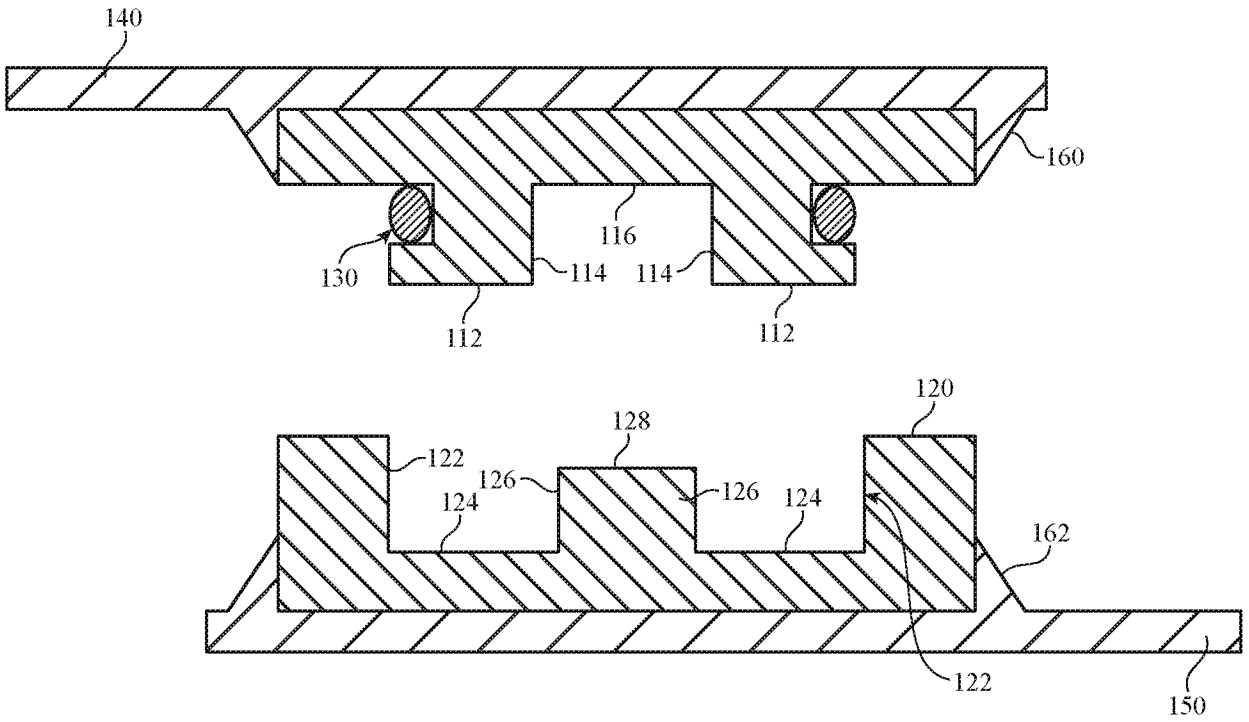
FIG. 1 illustrates a portion of an electronic system according to an embodiment of the present invention.

FIG. 1 illustrates a portion of an electronic system according to an embodiment of the present invention. This figure, as with the other included figures, is shown for illustrative purposes and does not limit either the possible embodiments of the present invention or the claims. Also, while the term waterproof may be used herein, it is understood that embodiments of the present invention may provide waterproofing or at least an increased resistance to water (or other fluid.)

This figure includes a board-to-board connector having a seal. This seal may act in conjunction with one or more seals in or at a device housing or enclosure to provide a redundant level of waterproofing or increase in water (or other fluid) resistance. This increase in water resistance may protect contacts in the board-to-board connector, as well as traces in boards and components connected to the boards attached to the board-to-board connector. That is, this seal may provide an additional increase in water resistance that may otherwise be provided by seals, such as seals at or in a device enclosure or housing. In other embodiments of the present invention, this board-to-board connector may be submersible. In this case, the seal may provide a front line of water resistance.

Specifically, this figure includes a board-to-board connector including board-to-board connector insert 110 and board-to-board connector receptacle 120. Connector insert 110 may be attached to a first board 140. Connector receptacle 120 may be attached to a second board 150. Traces in a first board 140 may be electrically connected to contacts in insert 110. These contacts may be located in various positions on connector insert 110 in various embodiments of the present invention. For example, these contacts may be located at positions 112, 114, or 116, or combinations thereof. Traces in the second board 150 may be electrically connected to contacts in connector receptacle 120. These contacts may be located in various positions on connector receptacle 120 in various embodiments of the present invention. For example, these contacts may be located at positions 122, 124, 126, 128, or combinations thereof.

A seal 130 may be located between connector insert 110 and connector receptacle 120. This seal may be an O-ring, gasket, or other type of seal. For example, seal 130 may be an O-ring having a circular cross section as shown. In other embodiments of the present invention, seal 130 may be a multi-lobed O-ring. In various embodiments of the present invention, the seal 130 may be lubricated or covered with grease, oil, or other lubricant to facilitate the insertion and extraction of connector insert into and out of connector receptacle 120.

In this embodiment of the present invention, notch 119 may be formed in a housing of board-to-board connector insert 110. Seal 130 may be stretched radially around the housing of the connector insert 110. More specifically, seal 130 may be located or seated in notch 119. In this way, the inclusion of seal 130 may have no or only a limited effect in the overall height, width, and length of the board-to-board connector. When connector insert 110 is inserted into connector receptacle 120, seal 130 may contact sealing surface or face 122.

In various embodiments of the present invention, it may be highly desirable to be able to rework or replace either or both boards 140 and 150. Accordingly, embodiments of the present invention may provide a board-to-board connector where the inserts may be readily and repeatedly inserted into and extracted from a corresponding receptacle. Moreover, this force may be adjusted by varying the durometrics or hardness of seal 130. Also, in various embodiments of the present invention, a mating face 122 of a connector receptacle may be undercut or be shaped in other ways to adjust the insertion and extraction forces. In this way, a holding force of a connector insert in a connector receptacle may be adjusted to improve the reliability of a connection formed by the board-to-board connector.

In various embodiments of the present invention, the waterproofing or fluid resistance of this board-to-board connector may be supplemented in various ways. For example, in this example and the other embodiments of the present invention, the areas or edges of attachment between a board-to-board insert and a board-to-board receptacle and their corresponding boards may be potted or otherwise sealed. For example, an area or edge of attachment between a board 140 and board-to-board connector insert 110 may be potted at locations 160. This potting, and the other potting shown in these examples, may be done with adhesives, such as epoxy, liquid or high viscosity plastic, or other material. In still other embodiments of the present invention, board 140 may itself may be covered with a waterproof or water resistant coating, such as a potting material, conformal coating, or other such coating. Similarly, an area or edge of attachment between board 150 and board-to-board connector receptacle 120 may be potted at locations 162. In still other embodiments the present invention, board 150 may be covered with a waterproof or water resistant coating, such as a parting material, conformal coating, or other such coating.

Figure 2:
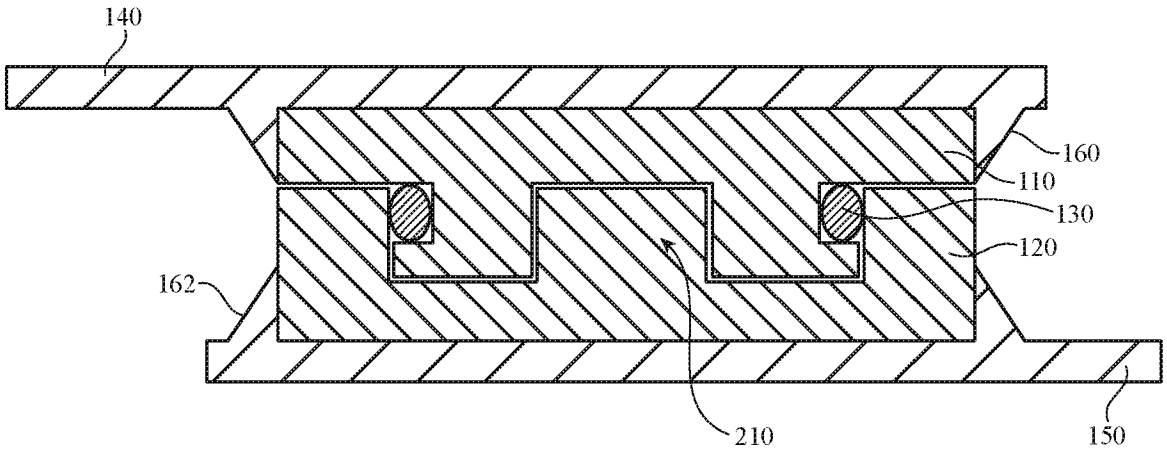
FIG. 2 illustrates a portion of an electronic system according to an embodiment of the present invention.

FIG. 2 illustrates a portion of an electronic device according to an embodiment of the present invention. More specifically, this figure illustrates a board-to-board connector where a board-to-board connector insert has been inserted into a board-to-board connector receptacle. In this example, seal 130 is compressed such that the ingress path between the board-to-board connector insert 110 and board-to-board connector receptacle 120 is blocked by seal 130. The ingress path between board-to-board connector insert 110 and board 140 may be blocked by potting 160. Similarly, an ingress path between board-to-board receptacle 120 and board 150 may be blocked by potting material 162. This may protect the contacts in the center 210 of the board-to-board connector from exposure to water or other corrosive fluids.

When a connector insert is mated with a connector receptacle, traces in a first board may be electrically connected to traces in a second board. In this example, traces in board 140 may be electrically connected to contacts in a center region 210 of board-to-board connector insert 110. These contacts may form electrical connections with corresponding contacts in a center portion 210 of board-to-board connector receptacle 120. The contacts in connector receptacle 120 may be electrically connected to traces in board 150. In this way, electrical components or circuits on board 140 may be electrically connected to components or circuits on board 150.

In the above examples, seal 130 may be located in a notch 119 formed in an outer edge of board-to-board connector insert 110. In other embodiments of the present invention, seal 130 may be located in a notch formed in an inner edge of board-to-board connector receptacle 120. For example, the notch may be located in face 122 of board-to-board connector receptacle 120. In still other embodiments of the present invention, seal 130 may be located in a notch formed in another surface of the connector insert or receptacle. An example is shown in the following figure.

Figure 3:
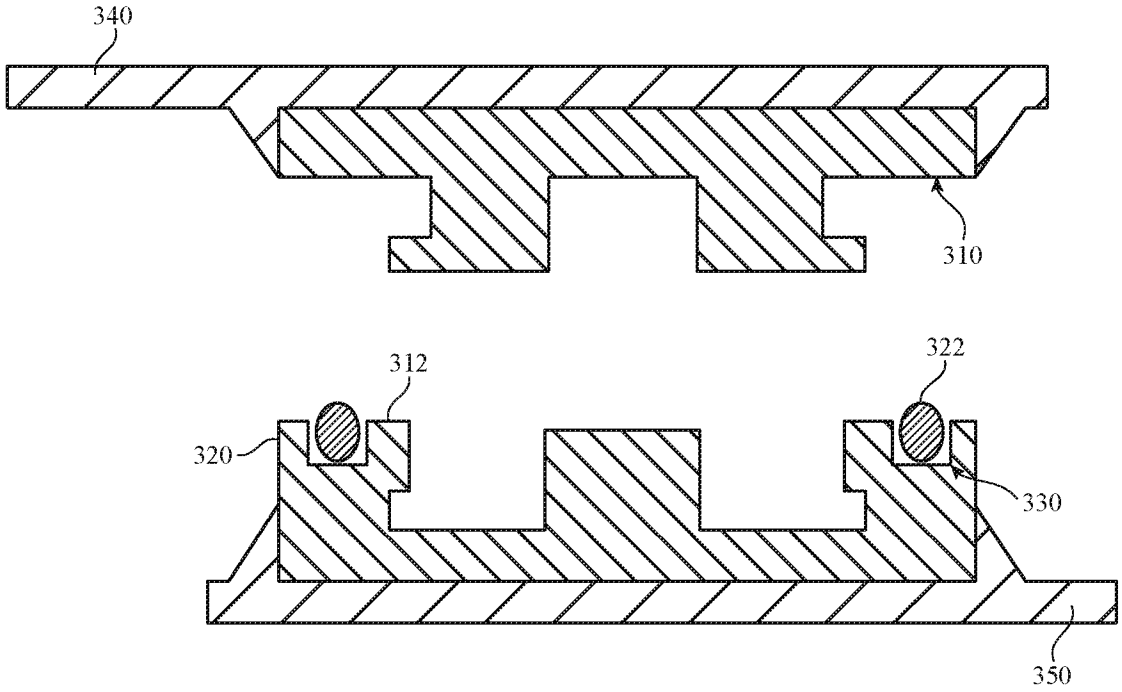
FIG. 3 illustrates a portion of an electronic system according to an embodiment of the present invention.

FIG. 3 illustrates a portion of an electronic device according to an embodiment of the present invention. In this example, a board-to-board connector insert 310 may be attached to a first board 340 and a board-to-board connector receptacle 320 may be attached to a second board 350. A seal 330 may be used to block a fluid ingress path between board-to-board connector insert 310 and board-to-board connector receptacle 320. Seal 330 may be placed or seated in notch 332 in a top surface of connector receptacle 320. Seal 330 may contact a top surface 312 or connector insert 310. The board-to-board connector insert 310 and board-to-board connector receptacle 320 may include contacts and may be potted to their respective boards as shown above.

Figure 4:
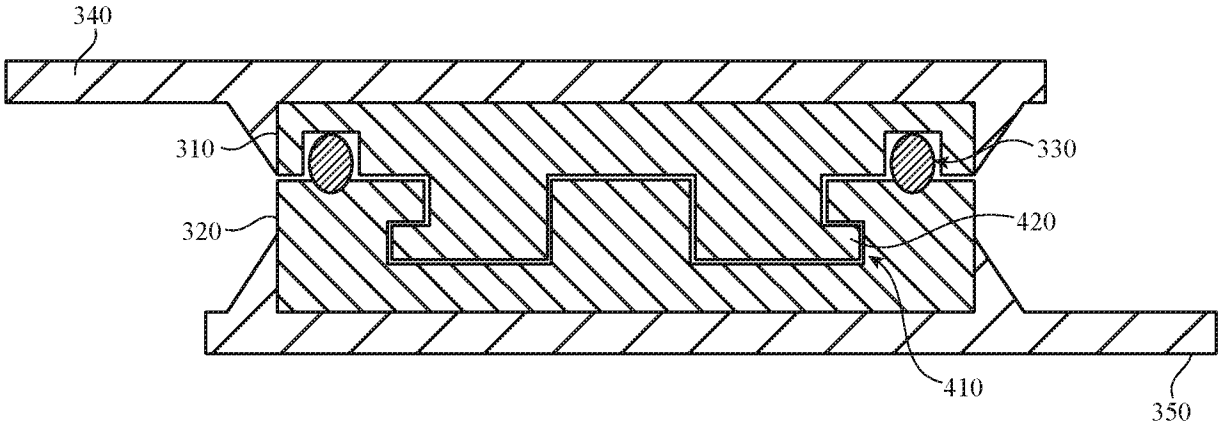
FIG. 4 illustrates a portion of an electronic system according to an embodiment of the present invention.

FIG. 4 illustrates a portion of an electronic device according to an embodiment of the present invention. In this figure, board-to-board connector insert 310 has been inserted into board-to-board connector receptacle 320. Seal 330 may be compressed to block and ingress path between board-to-board connector insert 310 and board-to-board connector receptacle 320.

Clips 410 may be included on a connector insert 310. Clips 410 may be seated in notches 420 in connector receptacle 320. These clips 410 and notches 420 may help keep connector insert 310 seated in connector receptacle 320. This may further help to keep seals 130 under compression to form an effective fluid ingress block. During insertion, clips 410 may deflect then retract into notch 420 to allow the insertion of connector insert 310 into connector receptacle 320. This action may provide a snap as the connector insert 310 is inserted into and extracted from connector receptacle 320.

Again, the seals employed by embodiments the present invention may be formed in various ways and of various materials. An example is shown in the following figure.

Figure 5:
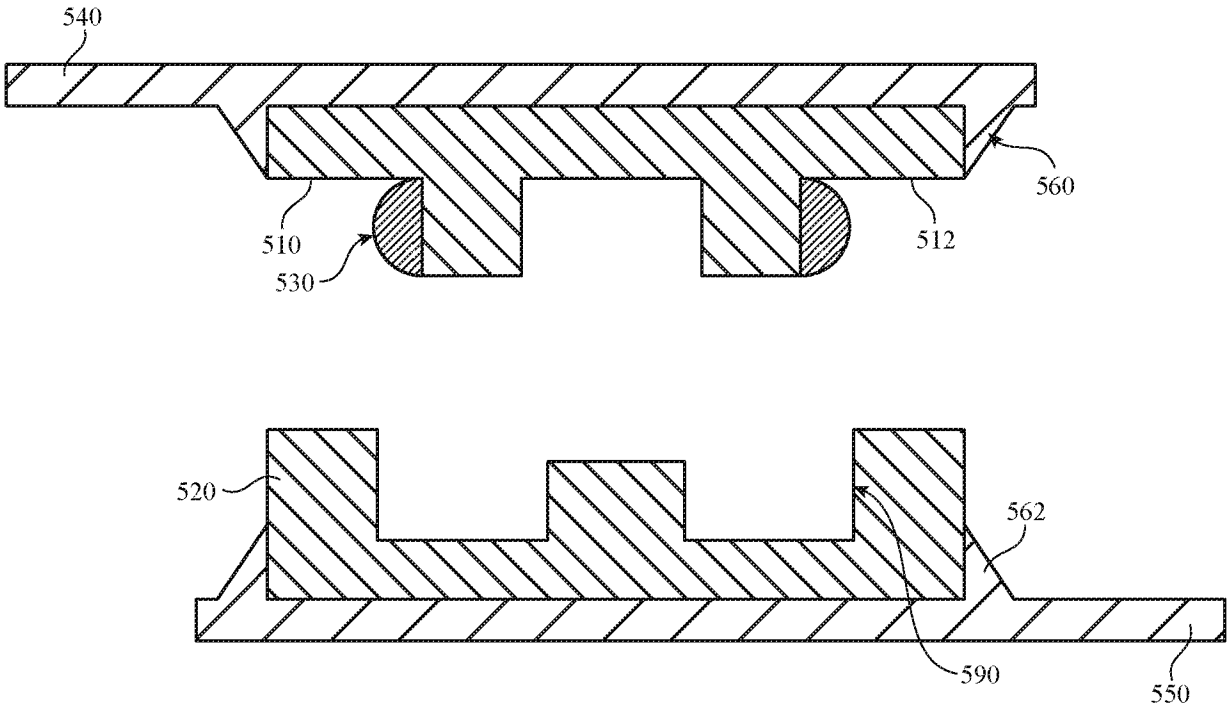
FIG. 5 illustrates a portion of an electronic system according to an embodiment of the present invention.

FIG. 5 illustrates a portion of an electronic device according to an embodiment of the present invention. In this example, board-to-board connector insert 510 may be attached to board 540. This attachment, as in the other examples, may be sealed with potting material 560. Board-to-board connector receptacle 520 may be attached to a second board 550. As in the other examples, this attachment may be sealed with a potting material, shown here as potting material 562.

In this example, board-to-board connector insert 510 may be formed using a double or two-shot manufacturing process. Specifically, the housing 512 may be molded around a plurality of contacts (not shown) located in positions as shown in FIG. 1. This mold may be relatively rigid. A second shot may form seal 530. Seal 530 may be relatively more flexible than housing 512 and may be an elastomer or formed of another material. Seal 530 may mate with sealing face 590 after insertion. As in the other examples, sealing face 590 may be undercut to more securely hold seal 530 in place. By adjusting a size and hardness of seal 530, and a depth of an undercut on face 590, insertion and extraction forces for board-to-board connector insert 510 and board-to-board connector receptacle 530 may be tuned. This tuning may be used to adjust fluid resistance provided by seal 530, as well as to adjust the insertion and extraction forces needed to insert and remove connector insert 510 into and from connector receptacle 520.

Figure 6:
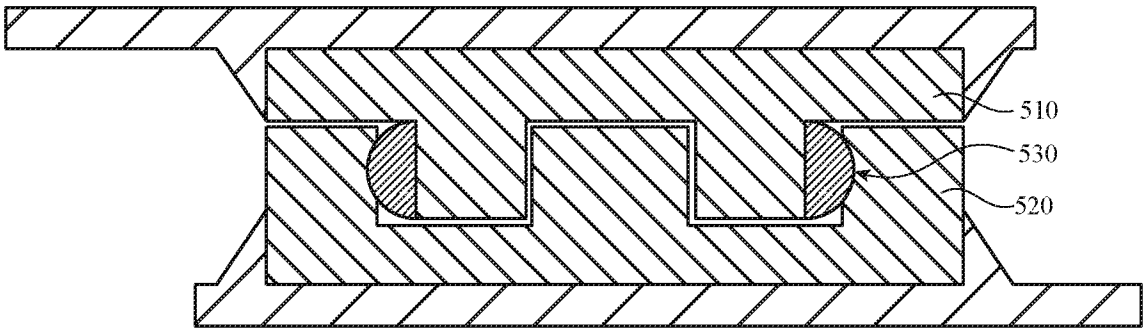
FIG. 6 illustrates a portion of an electronic system according to an embodiment of the present invention.

FIG. 6 illustrates a portion of an electronic device according to an embodiment of the present invention. In this example, when board-to-board connector insert 510 is mated with board-to-board connector receptacle 520, seal 530 may contact sealing surface or face 590 to block an ingress path between connector insert 510 and connector receptacle 520.

Again, seals between board-to-board connector inserts and board-to-board connector receptacles may be formed of various materials. An example is shown in the following figure.

Figure 7:
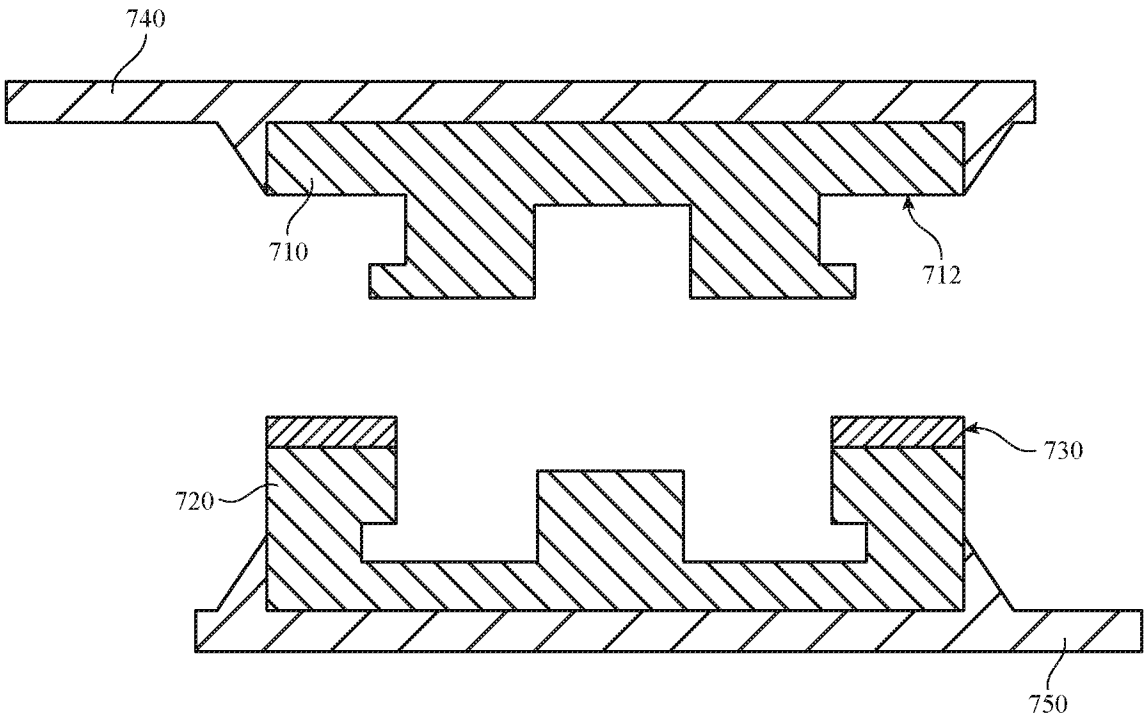
FIG. 7 illustrates a portion of an electronic system according to an embodiment of the present invention.

FIG. 7 illustrates a portion of an electronic device according to an embodiment of the present invention. This figure includes a board-to-board connector insert 710 attached to a first board 740. A board-to-board connector receptacle 720 may be attached to a second board 750. In this example, adhesive 730 may engage a sealing surface 712 to block an ingress path between a connector insert 710 and connector receptacle 720. Adhesives 730 may be formed of a pressure sensitive adhesive, epoxy, double-sided tape, or other adhesive. This adhesive may also be used to adjust insertion and extraction force for this board-to-board connector. As with each of the other examples shown, the connectors in this embodiment may include contacts in locations shown in FIG. 1 and they may be potted as in the other examples.

Figure 8:
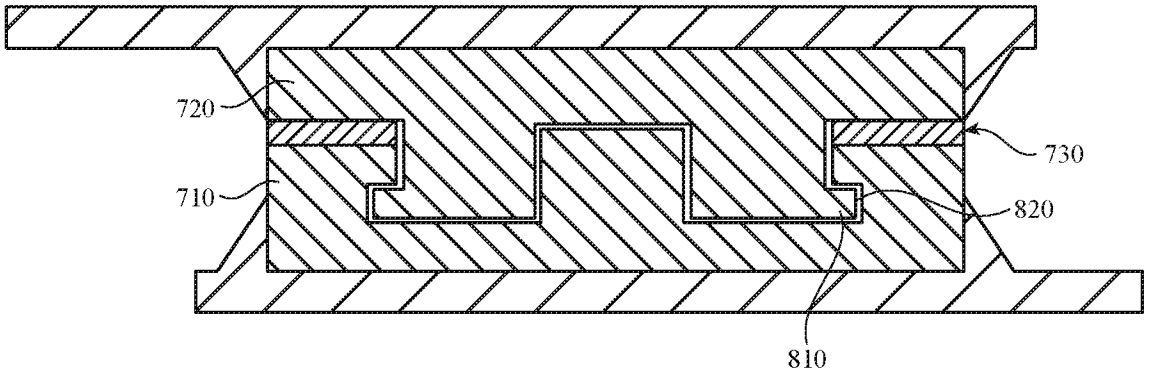
FIG. 8 illustrates a portion of an electronic system according to an embodiment of the present invention.

FIG. 8 illustrates a portion of an electronic device according to an embodiment of the present invention. In this example, adhesive layer 730 may block an ingress path between board-to-board connector insert 710 and board-to-board connector receptacle 720. As in other embodiments of the present invention, either or both connector inserts 710 or connector receptacles 720 may include clips 810 and notches 820. These clips and notches may secure connector insert 720 in place in connector receptacle 720. This may keep a force applied to adhesive layer 730, thereby improving the fluid resistance provided.

In other embodiments of the present invention, other types of seals may be used. For example, seals may be provided around one or more contacts. An example is shown in the following figure.

Figure 9:
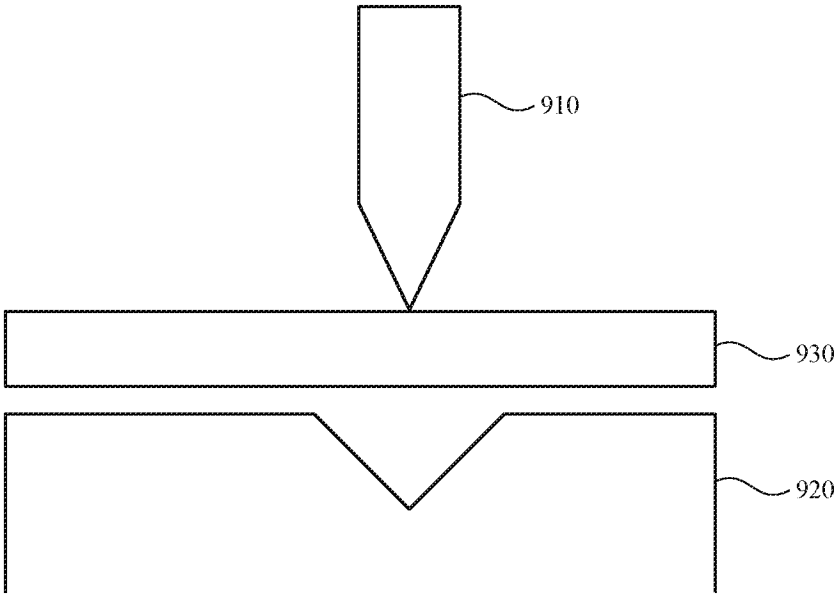
FIG. 9 illustrates a portion of a board-to-board connector according to an embodiment of the present invention.

FIG. 9 illustrates a portion of a board-to-board connector according to an embodiment of the present invention. In this example, a sealing layer 930 may be located between a first contact 910 and a second contact 920. Contact 910 may be in a connector insert or receptacle, while contact 920 may be in a corresponding connector receptacle or insert. Sealing layer 930 may be a silicone or other type of layer that may provide an increased fluid resistance between a board-to-board connector insert and a board-to-board connector receptacle. Sealing layer 930 may be placed around individual contacts, or it may be a layer placed between an insert and receptacle. When the board-to-board connector insert is inserted into the board-to-board connector receptacle, sealing layer 930 may be pierced, allowing an electrical connection between contacts 910 and 920. Sealing layer 930 may be cored or have material removed in various locations to allow the silicone or other material to flow laterally when this electrical connection is formed. An example is shown in the following figure.

Figure 10:
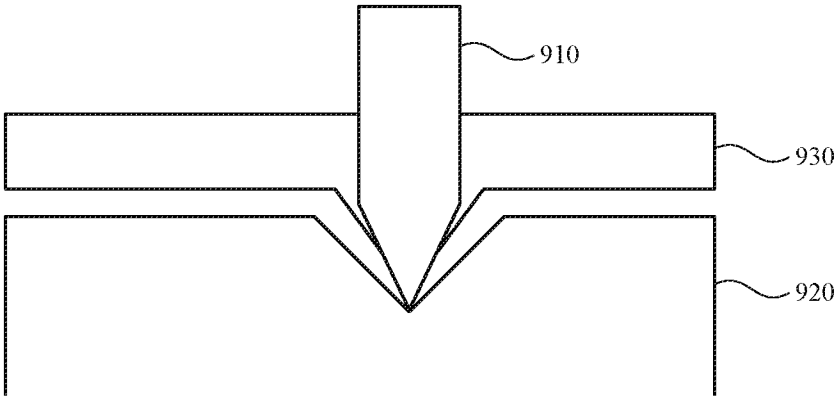
FIG. 10 illustrates a portion of a board-to-board connector according to an embodiment of the present invention.

FIG. 10 illustrates a portion of a board-to-board connector according to an embodiment of the present invention. In this example, a board-to-board connector insert has been inserted into a board-to-board connector receptacle. Contact 910 has pierced sealing layer 930 to make an electrical contact with contact 920.

Figure 11:
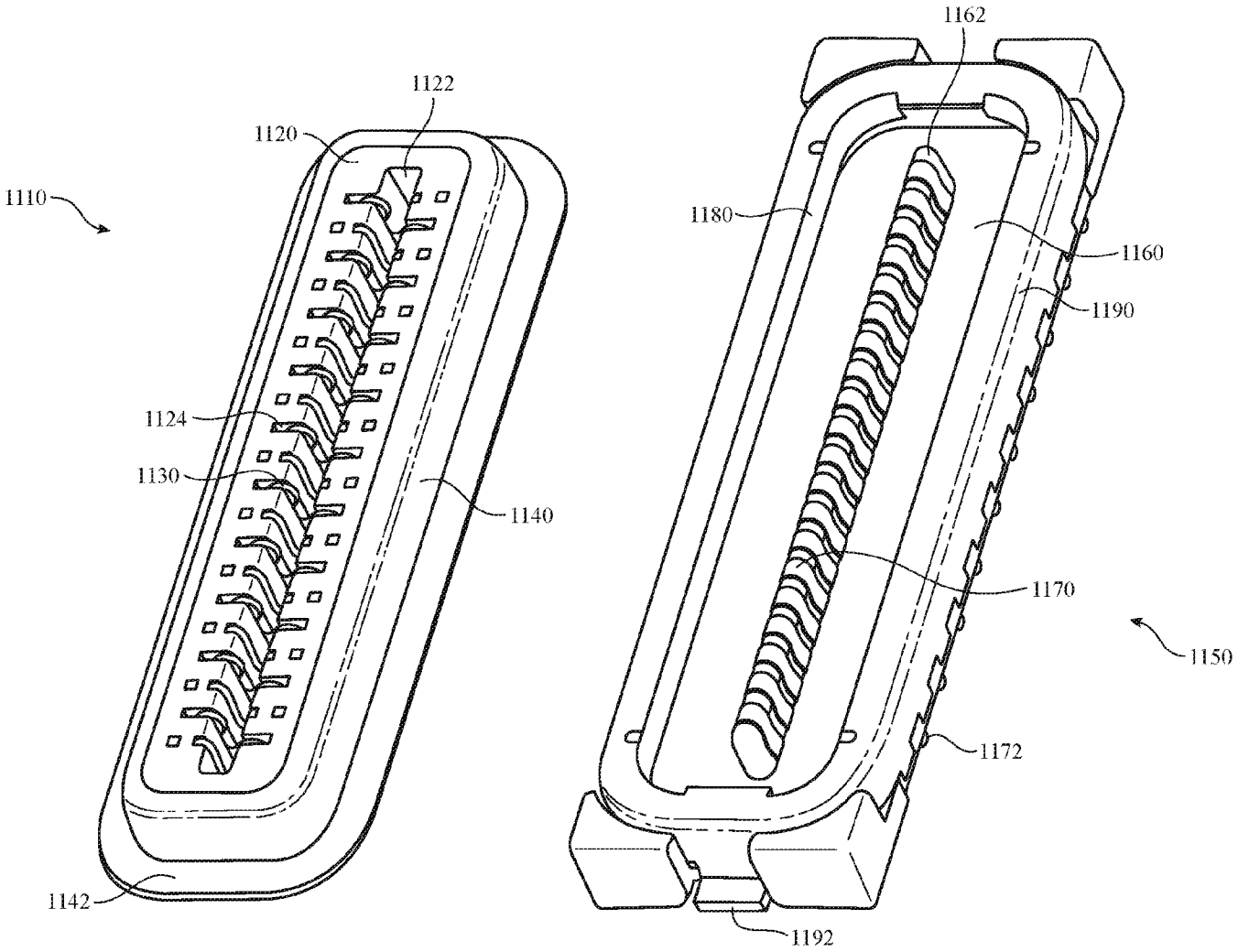
FIG. 11 illustrates a board-to-board connector system according to an embodiment of the present invention.

FIG. 11 illustrates a board-to-board connector system according to an embodiment of the present invention. This example includes a receptacle 1110 and a plug 1150. Silicone ring or gasket 1180 may form a seal between shell 1140 of receptacle 1110 and shell 1190 of plug 1150. This seal may prevent the ingress of moisture into the connector.

Receptacle 1110 may include housing 1120 in shell 1140. Housing 1120 may include a number of slots 1124 for contacts 1130. Housing 1120 may further include an opening 1122 to accept a raised portion 1162 on plug 1150. Shell 1140 may include flange 1142.

Plug 1150 may include housing 1160. Housing 1160 may include a raised portion 1162 to mate with opening 1122 in housing 1120 of receptacle 1110. Contacts 1170 may be exposed along the top and sides of raised portion 1162. Contacts 1170 may terminate in surface mount portions 1172. Shell 1190 may include flange 1192. Silicone ring or gasket 1180 may be formed along an inside portion of shell 1190.

When plug 1150 is mated with receptacle 1110, raised portion 1162 of plug 1150 may be inserted into opening 1122 of receptacle 1110. Housing 1120 and shell 1140 of receptacle 1110 may fit in the recess formed by shell 1190 and silicone ring or gasket 1180 of plug 1150. A side view of this is shown in the following figure.

Figure 12:
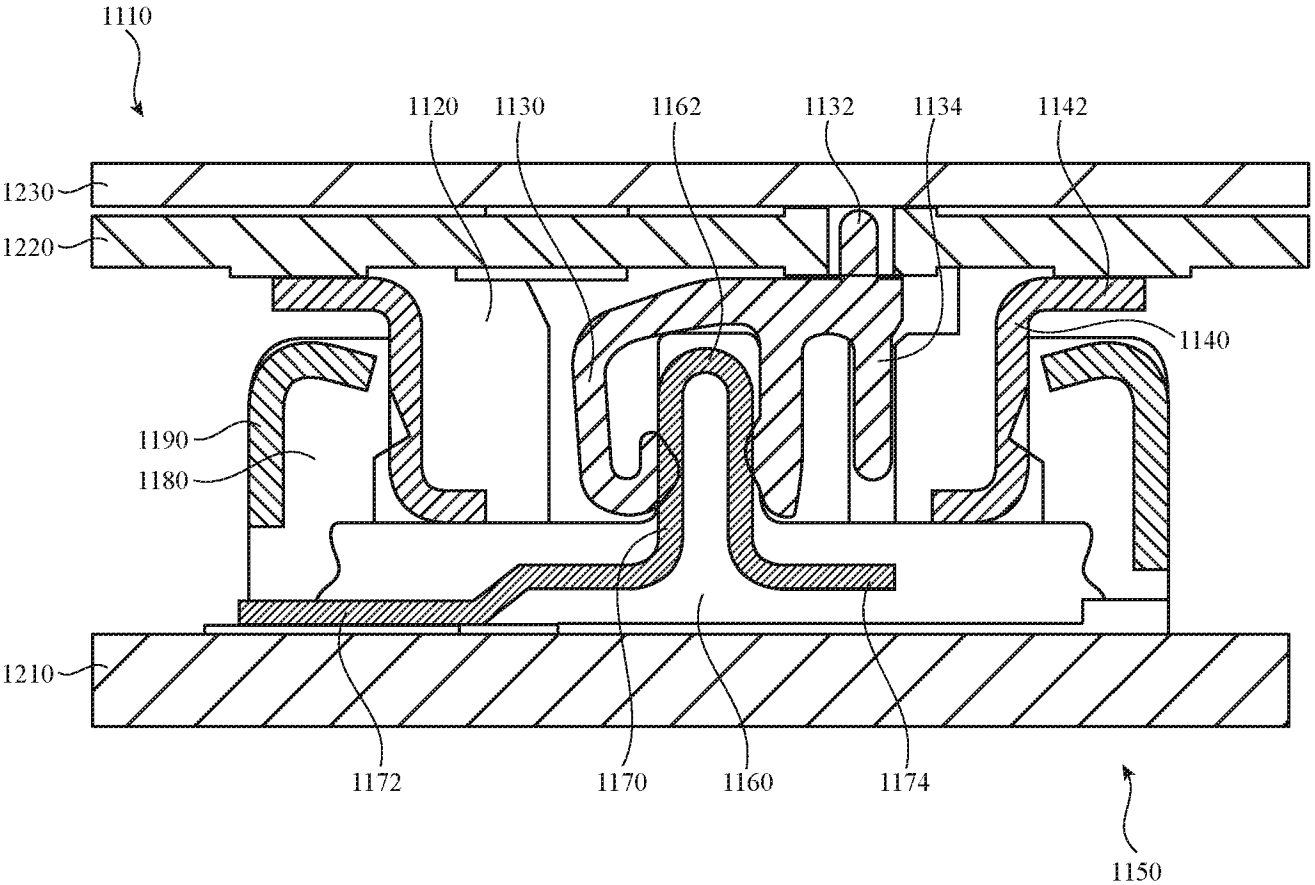
FIG. 12 illustrates a side view of a portion of an electronic device according to an embodiment of the present invention.

FIG. 12 illustrates a side view of a portion of an electronic device according to an embodiment of the present invention. In this example, plug 1150 may be mounted on a flexible circuit board, printed circuit board, or other appropriate substrate 1210. Receptacle 1110 may be mounted on a flexible circuit board, printed circuit board, or other appropriate substrate 1220.

Traces or pads on flexible or printed circuit board 1210 may be electrically connected to surface mount portions 1172 of contacts 1170 in plug 1150. Flexible or printed circuit board 1210 may be mechanically supported by a cowling or other structure (not shown.) Contacts 1170 may further include a stabilizing portion 1174. Stabilizing portion 1174 may be embedded in housing 1160. Contact 1170 may include a U-shaped portion exposed on a surface of raised portion 1162 of housing 1160. Plug 1150 may further include shell 1190 and silicone ring or gasket 1180.

Contacts 1170 may electrically connect to contacts 1130 in receptacle 1110. Contacts 1130 may further include barb 1134 that be secured in place in housing 1120. Contacts 1130 may further include through-hole portions 1132 to connect to traces in flexible or printed circuit board 1220. Flexible or printed circuit board 1220 may be mechanically supported by cowling or other structure 1230. Receptacle 1110 may further include shell 1140. Shell 1140 may include flange 1142. Flange 1142 may be soldered to flexible or printed circuit board 1220 to provide further protection against moisture ingress by preventing leakage between shell 1140 and flexible or printed circuit board 1220.

Silicone ring or gasket 1180 may be located between shell 1190 of plug 1150 and shell 1140 of receptacle 1110. This silicone ring or gasket 1180 may prevent moisture ingress into the board-to-board connector.

Traces in flexible or printed circuit board 1210 may electrically connect to traces in flexible or printed circuit board 1220 through surface mount portion 1172, contacts 1170, contacts 1130, and through-hole portions 1132.

Shell 1140 of receptacle 1110 and shell 1190 of plug 1150 may be electrically connected to ground or other potential, or they may be floating. They may contact or otherwise be electrically connected to each other, or they be separate. In one embodiment of the present invention, they may each be grounded and they may contact each other to form a faraday cage around contacts 1130 in receptacle 1110 and contacts 1170 in plug 1150. In another embodiment of the present invention, they may each be floating and separate from each other.

In this example, contacts 1170 are shown as having surface mount portions 1172, though in other embodiments of the present invention, contacts 1170 may be through-hole contacts having through-hole portions to connect to traces in flexible or printed circuit board 1210. Similarly, while contacts 1130 are shown as having through-hole portions 1132, in other embodiments of the present invention, contacts 1130 may be surface-mount contacts having surface-mount portions to connect to traces in flexible or printed circuit board 1220.

As with the above examples, this board-to-board connector may provide a connector that may allow reworking during assembly. For example, flexible or printed circuit board 1220 attached to receptacle 1110 may be connected to plug 1150. If it is found that flexible or printed circuit board 1220 is nonfunctional, flexible or printed circuit board 1220 may be extracted, and a new flexible or printed circuit board 1220 and receptacle 1110, or a reworked flexible or printed circuit board 1220 and receptacle 1110, may be inserted into plug 1150.

Figure 13:
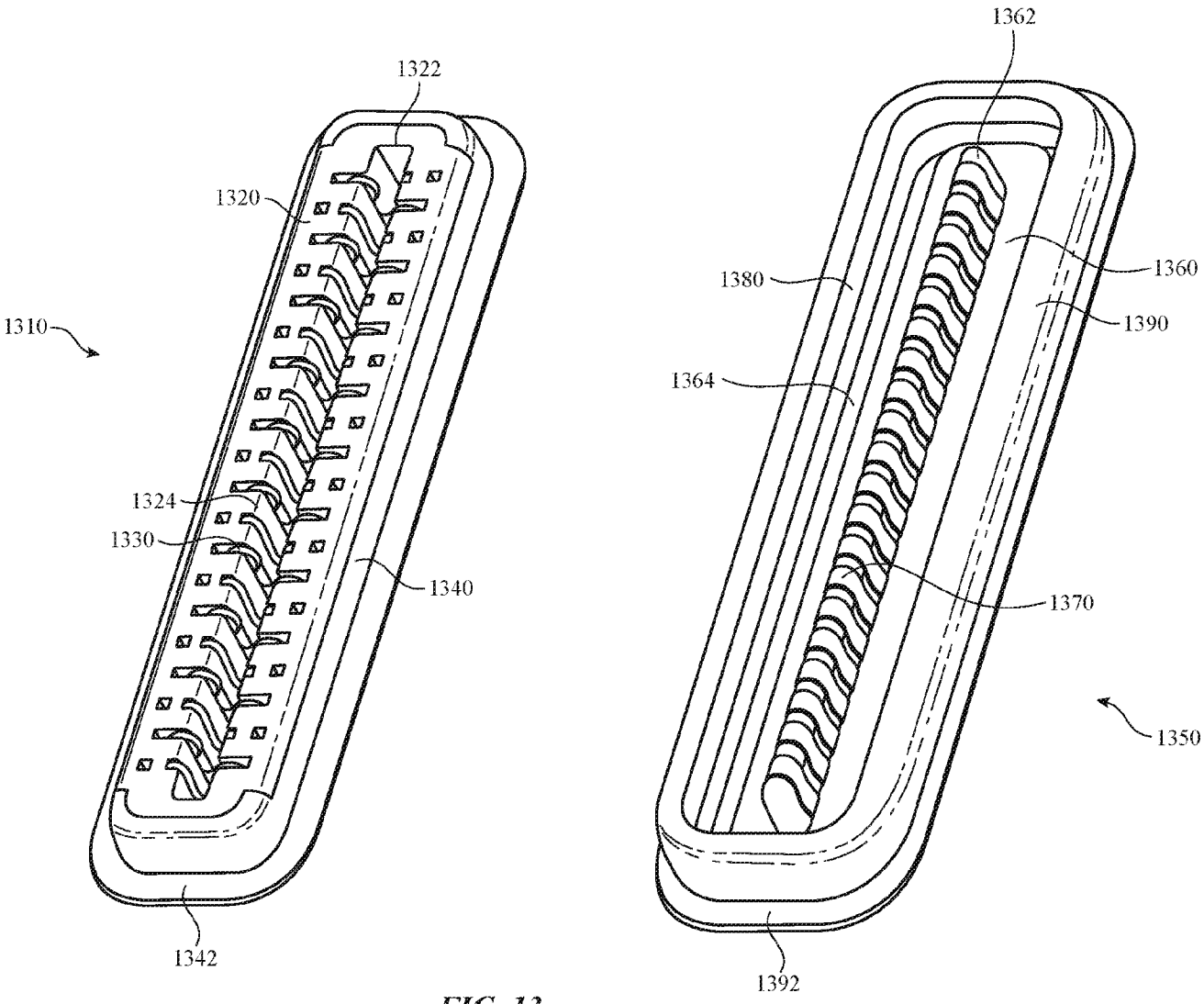
FIG. 13 illustrates another board-to-board connector system according to an embodiment of the present invention.

FIG. 13 illustrates another board-to-board connector system according to an embodiment of the present invention. This example includes a receptacle 1310 and a plug 1350. Silicone ring or gasket 1380 may form a seal between shell 1340 of receptacle 1310 and shell 1390 of plug 1350. This seal may prevent the ingress of moisture into the connector.

Receptacle 1310 may include housing 1320 in shell 1340. Housing 1320 may include a number of slots 1324 for contacts 1330. Housing 1320 may further include an opening 1322 to accept a raised portion 1362 on plug 1350. Shell 1340 may include flange 1342.

Plug 1350 may include housing 1360. Housing 1360 may include a raised portion 1362 to mate with opening 1322 in housing 1320 of receptacle 1310. Contacts 1370 may be exposed along the top and sides of raised portion 1362. Contacts 1370 may terminate in surface mount portions 1372. Shell 1390 may include flange 1392. Silicone ring or gasket 1380 may be formed along an inside portion of shell 1390. A gap 1364 may exist between silicone ring or gasket 1380 and housing 1360 in plug 1350.

When plug 1350 is mated with receptacle 1310, raised portion 1362 of plug 1350 may be inserted into opening 1322 of receptacle 1310. Housing 1320 and shell 1340 of receptacle 1310 may fit in the recess formed by shell 1390 and silicone ring or gasket 1380 of plug 1350. A side view of this is shown in the following figure.

Figure 14:
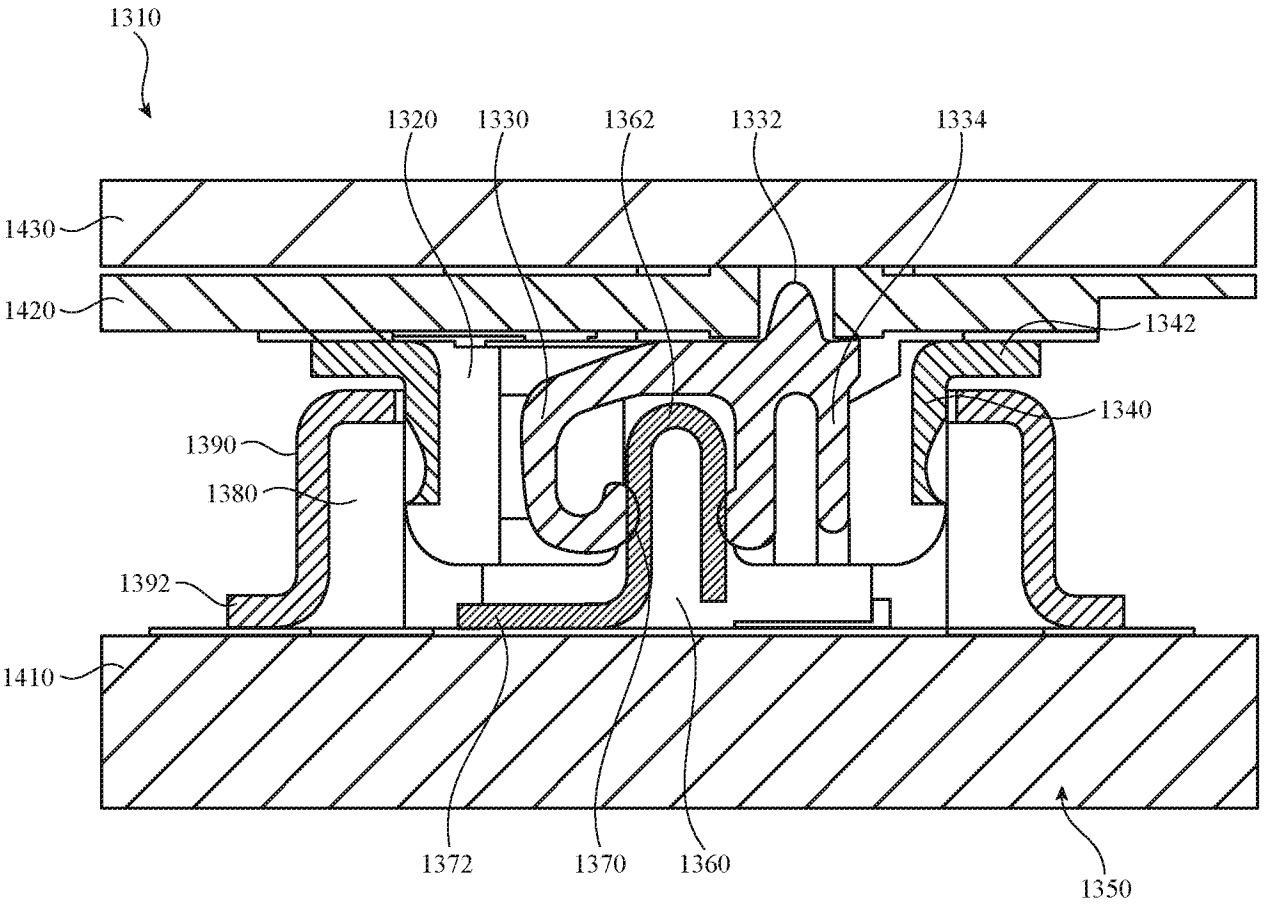
FIG. 14 illustrates a side view of a portion of an electronic device according to an embodiment of the present invention.

FIG. 14 illustrates a side view of a portion of an electronic device according to an embodiment of the present invention. In this example, plug 1350 may be mounted on a flexible circuit board, printed circuit board, or other appropriate substrate 1410. Receptacle 1310 may be mounted on a flexible circuit board, printed circuit board, or other appropriate substrate 1420.

Traces or pads on flexible or printed circuit board 1410 may be electrically connected to surface mount portions 1372 of contacts 1370 in plug 1350. Flexible or printed circuit board 1410 may be mechanically supported by a cowling or other structure (not shown.) Contact 1370 may include a U-shaped portion exposed on a surface of raised portion 1362 of housing 1360. Plug 1350 may further include shell 1390 and silicone ring or gasket 1380. Shell 1390 may include flange 1392. Flange 1392 may be soldered to printed circuit board 1410 to provide further protection against moisture ingress by preventing leakage between shell 1390 and flexible or printed circuit board 1410.

Contacts 1370 may electrically connect to contacts 1330 in receptacle 1310. Contacts 1330 may further include barb 1334 that be secured in place in housing 1320. Contacts 1330 may further include through-hole portions 1332 to connect to traces in flexible or printed circuit board 1420. Flexible or printed circuit board 1420 may be mechanically supported by cowling or other structure 1430. Receptacle 1310 may further include shell 1340. Shell 1340 may include flange 1342. Flange 1342 may be soldered to flexible or printed circuit board 1420 to provide further protection against moisture ingress by preventing leakage between shell 1340 and flexible or printed circuit board 1420.

Silicone ring or gasket 1380 may be located between shell 1390 of plug 1350 and shell 1340 of receptacle 1310. This silicone ring or gasket 1380 may prevent moisture ingress into the board-to-board connector.

Traces in printed circuit board 1410 may electrically connect to traces in flexible or printed circuit board 1420 through surface mount portion 1372, contacts 1370, contacts 1330, and through-hole portions 1332.

Shell 1340 of receptacle 1310 and shell 1390 of plug 1350 may be electrically connected to ground or other potential, or they may be floating. They may contact or otherwise be electrically connected to each other, or they be separate. In one embodiment of the present invention, they may each be grounded and they may contact each other to form a faraday cage around contacts 1330 in receptacle 1310 and contacts 1370 in plug 1350. In another embodiment of the present invention, they may each be floating and separate from each other.

In this example, contacts 1370 are shown as having surface mount portions 1372, though in other embodiments of the present invention, contacts 1370 may be through-hole contacts having through-hole portions to connect to traces on flexible or printed circuit board 1410. Similarly, while contacts 1330 are shown as having through-hole portions 1332, in other embodiments of the present invention, contacts 1330 may be surface-mount contacts having surface-mount portions to connect to traces in flexible or printed circuit board 1420.

As with the above examples, this board-to-board connector may provide a connector that may allow reworking during assembly. For example, flexible or printed circuit board 1420 attached to receptacle 1310 may be connected to plug 1350. If it is found that flexible or printed circuit board 1420 is nonfunctional, flexible or printed circuit board 1420 may be extracted, and a new flexible or printed circuit board 1420 and receptacle 1310, or a reworked flexible or printed circuit board 1420 and receptacle 1310, may be inserted into plug 1350.

Receptacle 1310 and plug 1350 may be formed in various ways consistent with embodiments of the present invention. Examples are shown in the following figures. Receptacle 1110 and plug 1150 may be formed in the same or similar manner using the same or similar materials.

Figure 15:
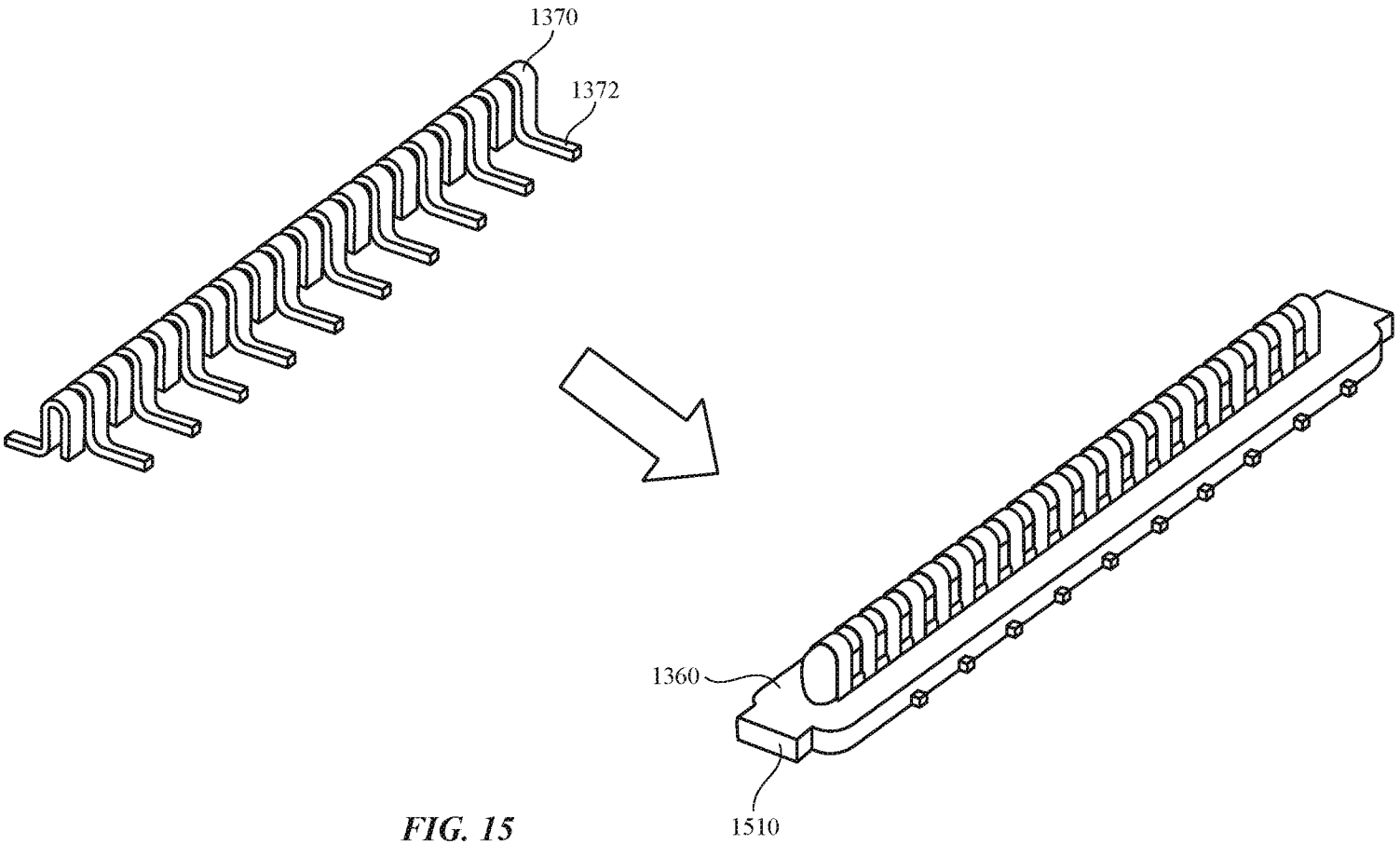
FIGS. 15-17 illustrate steps in the assembly of a plug according to an embodiment of the present invention.

FIG. 15 illustrates steps in the assembly of a plug according to an embodiment of the present invention. Contacts 1370 may be formed by stamping, printing, or other process. Contacts 1370 may be arranged such that surface mount portions 1372 of contacts 1370 extend in alternating directions as shown. This may provide an increased lateral spacing between surface mount portions 1372, thereby simplifying the attachment of the plug 1350 to a printed circuit board or other appropriate substrate. Housing 1360 may be injection molded around portions of contacts 1370. Housing 1360 may include tabs 1510. Housing 1360 may be formed of plastic or other nonconductive material.

Figure 16:
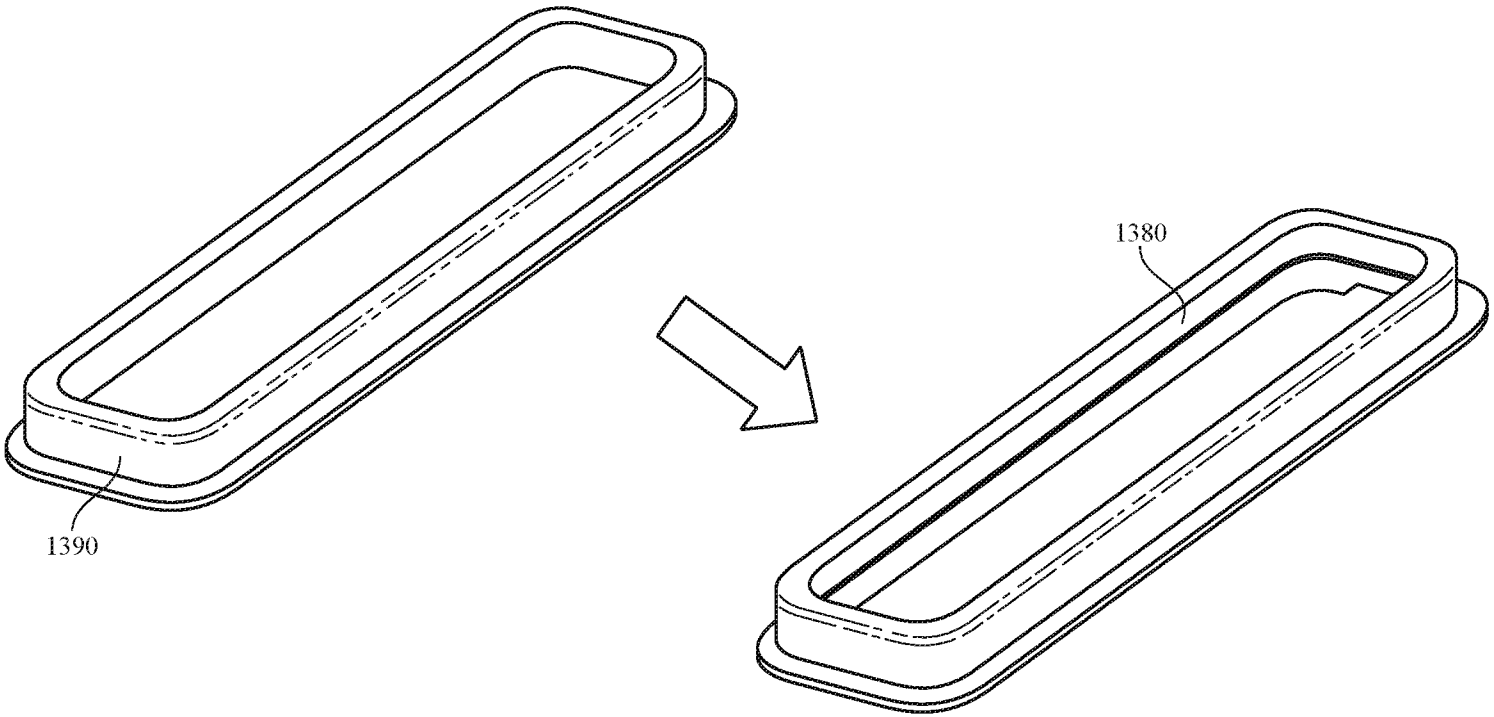

FIG. 16 illustrates steps in the assembly of a plug according to an embodiment of the present invention. Silicone ring or gasket 1380 may be insert molded along an inside edge of shell 1390. Silicone ring or gasket 1180 may be formed of silicone, rubber, or other pliant material. Silicone ring or gasket 1180 may be insert molded, it may be formed separately then attached to shell 1390, or it may be formed in other ways. Shell 1390 may be metallic and stamped, printed, deep-drawn, or formed using other process.

Figure 17:
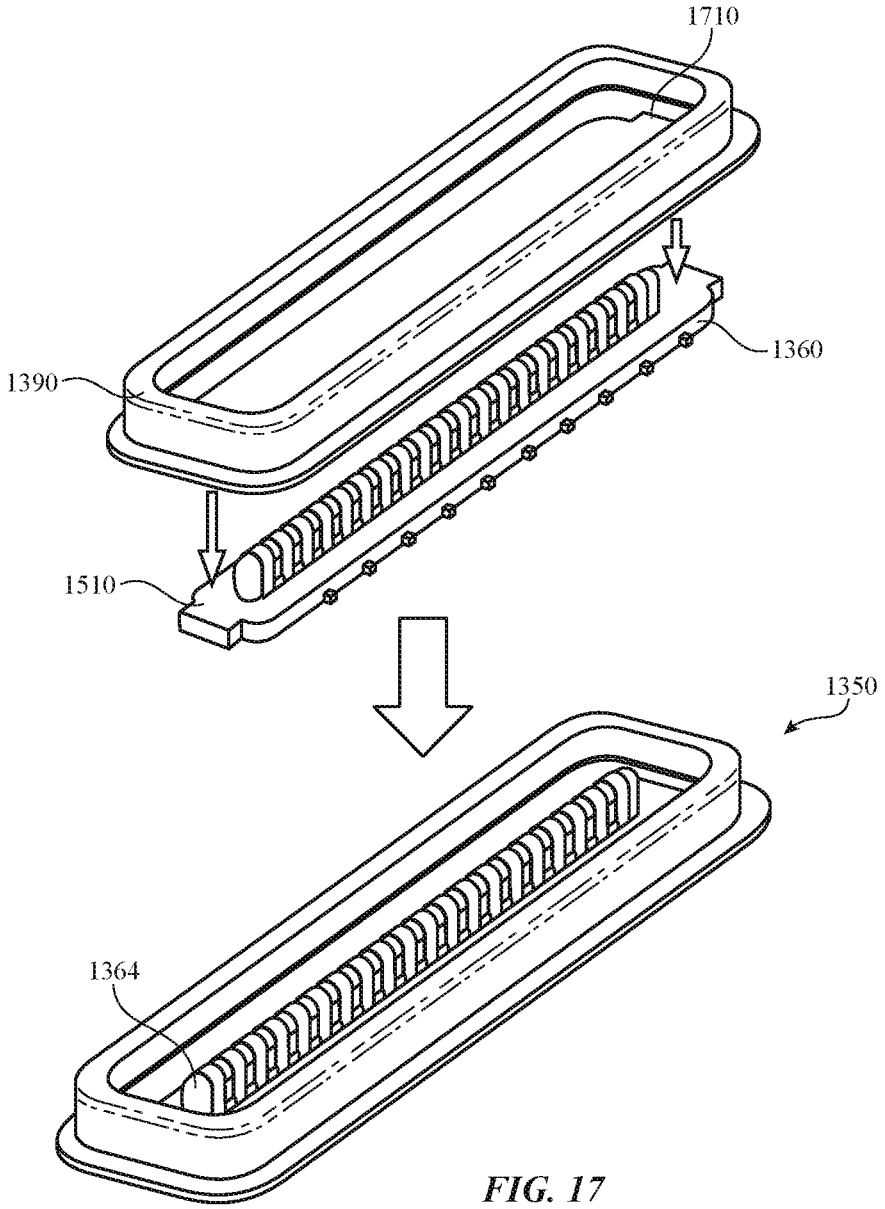

FIG. 17 illustrates steps in the assembly of a plug according to an embodiment of the present invention. Housing 1360 may be mated with shell 1390. Specifically, tabs 1510 of housing 1560 may be mated with notches 1710 on shell 1390. Tabs 1510 may be press-fit into notches 1710, or they may be joined in other ways. As before, gap 1364 may exist between housing 1360 and shell 1390.

Figure 18:
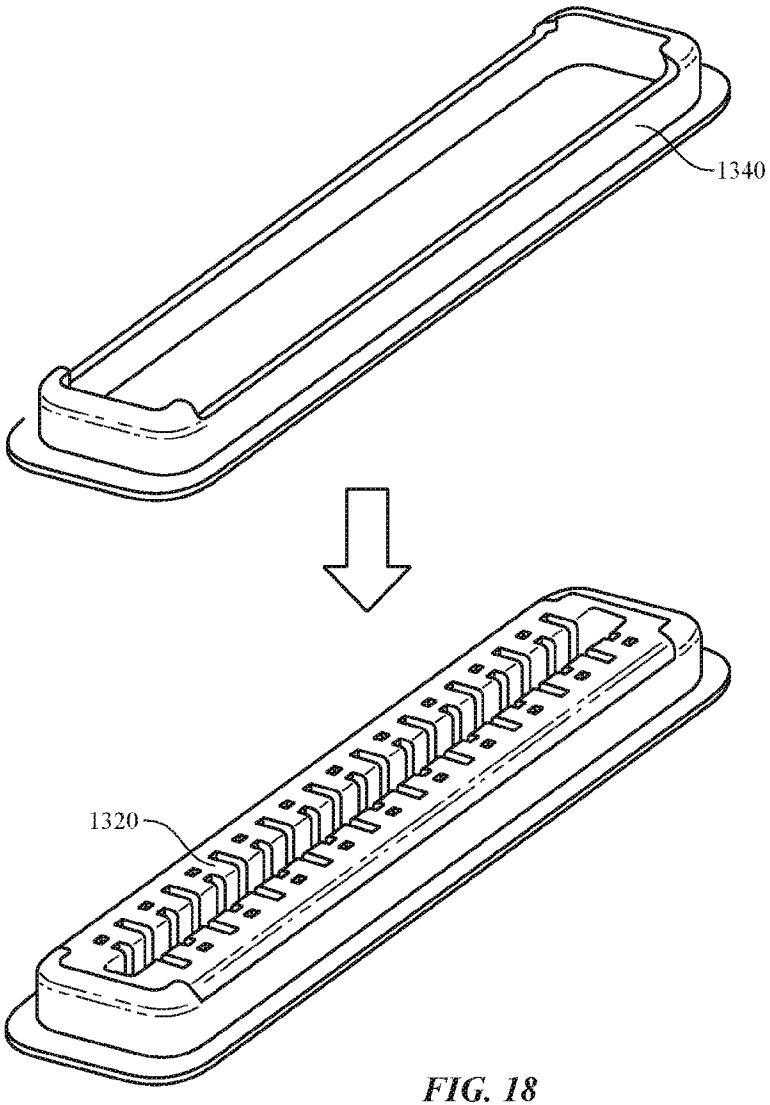
FIGS. 18-19 illustrate steps in the assembly of a receptacle according to an embodiment of the present invention.

FIG. 18 illustrates steps in the assembly of a receptacle according to an embodiment of the present invention. In this example, housing 1320 may be insert molded into shell 1340. Housing 1320 may be plastic or other nonconductive material. Shell 1340 may be metallic and stamped, printed, deep-drawn, or formed using other process.

Figure 19:
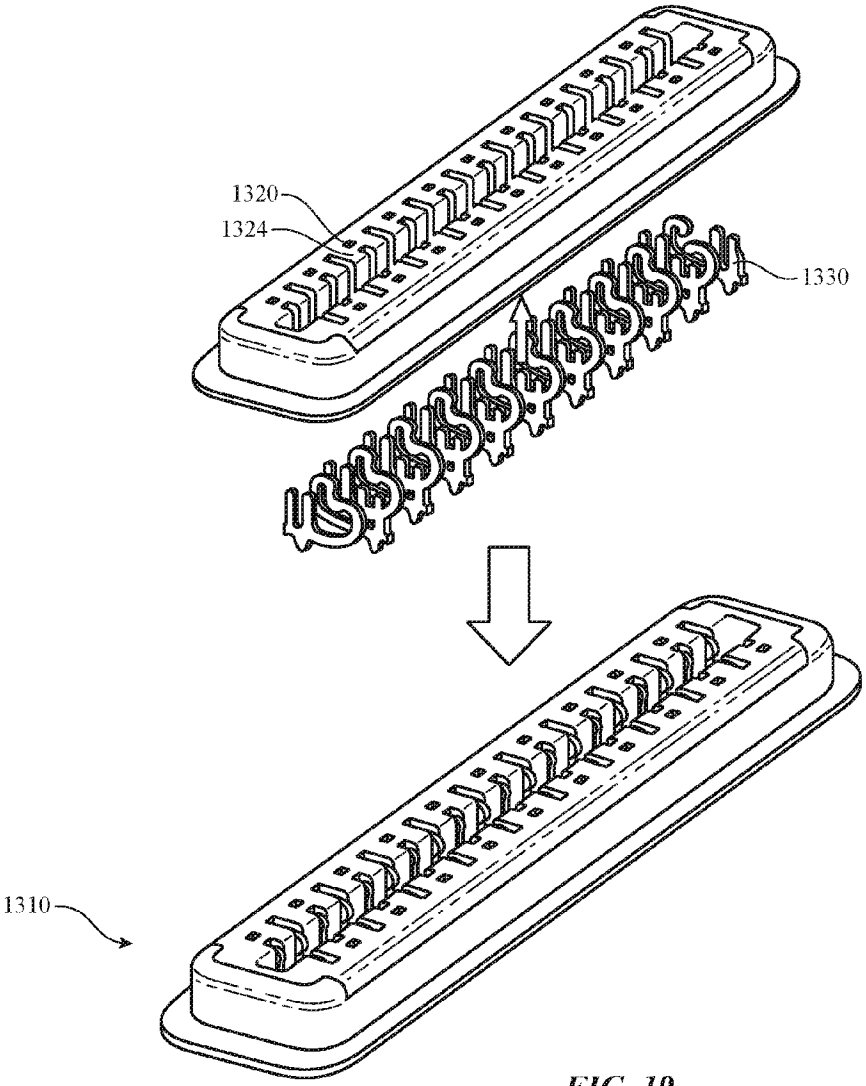

FIG. 19 illustrates steps in the assembly of a receptacle according to an embodiment of the present invention. Contacts 1330 may be inserted into openings 1324 in housing 1320. The result may be receptacle 1310. Contacts 1330 may be formed by stamping, printing, or other process. Contacts 1330 may be press-fit into openings 1324 in housing 1320 or inserted into openings 1324 in housing 1320 in other ways.

Again, embodiments of the present invention may provide connector receptacles that may be located in, and may connect to, various types of devices, such as portable computing devices, tablet computers, desktop computers, laptops, all-in-one computers, wearable computing devices, cell phones, smart phones, media phones, storage devices, portable media players, navigation systems, monitors, power supplies, adapters, remote control devices, chargers, and other devices. These connector receptacles may provide pathways for signals that are compliant with various standards such as Universal Serial Bus (USB), High-Definition Multimedia Interface® (HDMI), Digital Visual Interface (DVI), Ethernet, DisplayPort, Thunderbolt™, Lightning™, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. In various embodiments of the present invention, these interconnect paths provided by these connector receptacles may be used to convey power, ground, signals, test points, and other voltage, current, data, or other information.

The board-to-board connector receptacles and inserts employed by embodiments of the present invention may be connected to various types of boards. For example, they may be connected to flexible circuit boards, printed circuit boards, or other appropriate substrates. These boards may include various layers having traces or planes on them, where the various traces and planes are connected using vias between layers. A flexible or printed circuit board may be formed as part of a larger flexible or printed circuit board that may form a logic or motherboard in an electronic device. In other embodiments of the present invention, these boards may be formed of conductive or metallic traces and planes in or on a nonconductive body. The nonconductive body may be formed of plastic or other materials.

In various embodiments of the present invention, the components of the board-to-board connectors may be formed in various ways of various materials. For example, contacts and other conductive portions of board-to-board connectors may be formed by stamping, metal-injection molding, machining, micro-machining, 3-D printing, or other manufacturing process. The conductive portions may be formed of stainless steel, steel, copper, copper titanium, phosphor bronze, or other material or combination of materials. They may be plated or coated with nickel, gold, or other material. The nonconductive portions, such as the receptacle and insert housings, O-rings, gaskets, and other portions, may be formed using injection or other molding, 3-D printing, machining, or other manufacturing process. The nonconductive portions may be formed of silicone or silicone, rubber, hard rubber, plastic, nylon, elastomers, liquid-crystal polymers (LCPs), ceramics, or other nonconductive material or combination of materials.

The above examples of embodiments of the present invention may have many common elements. For example, the contacts and their positions in the connector inserts and receptacles may be the same or different among each embodiment. The potting done at the connections and edges of the connector inserts and receptacles may likewise be the same or different among each embodiment. The boards also may be the same or different among each embodiment.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A board-to-board connector comprising:

a board-to-board connector insert comprising a first plurality of contacts and a frame, wherein the frame has an upper surface, a surface perpendicular to the upper surface, and a notch in the surface perpendicular to the upper surface;

a board-to-board connector receptacle comprising a corresponding second plurality of contacts, wherein the board-to-board connector receptacle is configured to be inserted into the frame of the board-to-board connector insert; and a seal between the board-to-board connector insert and the board-to-board connector receptacle, wherein the seal is an O-ring and the O-ring is located in the notch of the board-to-board connector insert.

2. The board-to-board connector of claim 1 wherein the O-ring is attached to the board-to-board connector insert and completely surrounds the first plurality of contacts to form a continuous seal.

3. The board-to-board connector of claim 2 wherein the O-ring has a circular cross section.

4. The board-to-board connector of claim 2 wherein the O-ring is a multi-lobed O-ring.

5. The board-to-board connector of claim 2 wherein the seal is coated with a lubricant.

6. The board-to-board connector of claim 1 wherein the seal is formed using silicone.

7. An electronic device comprising:

a first board comprising a first plurality of traces;

a board-to-board receptacle attached to the first board, the board-to-board receptacle comprising a first plurality of contacts electrically connected to the first plurality of traces;

a board-to-board insert inserted in the board-to-board receptacle, the board-to-board insert comprising a second plurality of contacts electrically connected to the first plurality of contacts;

a seal between the board-to-board receptacle and the board-to-board insert, wherein the seal is a pressure-sensitive adhesive; and a second board attached to the board-to-board insert, the second board comprising a second plurality of traces electrically connected to the second plurality of contacts.

8. A method of manufacturing a board-to-board connector, the method comprising:

molding a housing for a board-to-board connector at least partially around a plurality of contacts to form a board-to-board connector plug;

forming a silicone ring on a shell;

attaching the shell to the board-to-board connector plug; and piercing the silicone ring with contacts on a board-to-board connector receptacle to connect the board-to-board connector plug to the board-to-board connector receptacle.

9. The method of claim 8 wherein the housing is plastic.

10. The method of claim 8 wherein forming the silicone ring on the shell comprises insert molding the silicone ring along an inside edge of the shell.

11. The method of claim 8 wherein molding the housing for the board-to-board connector comprises injection molding the housing around portions of the plurality of contacts.

12. The board-to-board connector of claim 1 wherein the board-to-board connector receptacle comprises a frame to receive the board-to-board connector insert, the frame includes a notch, and the O-ring is located in the notch.

13. The board-to-board connector of claim 12 wherein the board-to-board connector insert has an upper surface, the board-to-board connector receptacle has a surface parallel to the upper surface, and the notch is in the surface parallel to the upper surface.

14. The board-to-board connector of claim 1 wherein the board-to-board connector insert comprises a clip, the board-to-board connector receptacle comprises a notch, and the clip is seated within the notch when the board-to-board connector insert is inserted into the board-to-board connector receptacle.

15. The board-to-board connector of claim 1 wherein the first plurality of contacts pierces the seal and forms an electrical connection with the second plurality of contacts when the board-to-board connector insert is inserted into the board-to-board connector receptacle.

16. The board-to-board connector of claim 2 wherein the O-ring is a ring with a circular cross section and the O-ring is formed from a material selected from the group consisting of: silicon, silicone, rubber, plastic, nylon, elastomers, liquid-crystal polymers, and ceramics.

17. The electronic device of claim 7 wherein the pressure-sensitive adhesive is double-sided.

18. The electronic device of claim 7 further comprising potting material that seals the first board to the board-to-board receptacle.

* * * * *